United States Patent [19]

Schosek

[11] 3,966,169

[45] June 29, 1976

[54] ROD AND PIPE PUSHER, PULLER DEVICE

[76] Inventor: William O. Schosek, P.O. Box 3626, North Fort Myers, Fla. 33903

[22] Filed: Sept. 22, 1975

[21] Appl. No.: 615,534

Related U.S. Application Data

[63] Continuation-in-part of Ser. No. 482,275, June 24, 1974, Pat. No. 3,907,253.

[52] U.S. Cl. ..... 254/29 R

[51] Int. Cl.[2] ..... E21B 19/00

[58] Field of Search ..... 254/29 R

[56] References Cited

UNITED STATES PATENTS

| | | | |
|---|---|---|---|
| 2,882,011 | 4/1959 | Ripstein | 254/29 R |
| 3,645,502 | 2/1972 | Stromp | 254/29 R |
| 3,807,695 | 4/1974 | Gremillion et al. | 254/29 R |

*Primary Examiner*—Al Lawrence Smith
*Assistant Examiner*—Robert C. Watson

[57] ABSTRACT

A rod and pipe pusher, puller device for operative attachment to a conventional type of tractor or truck mounted backhoe machine without removal of the backhoe bucket. The attachment of operation of the device is accomplished by the removal of a single pin from the drive linkage to the bucket from a hydraulic operated piston of the conventional mechanism of the backhoe machine. Means are provided to securely anchor the bucket to an upper central portion of the device and to connect said drive linkage to a power arm of the device to accomplish the rod and pipe pushing, pulling operation.

8 Claims, 5 Drawing Figures

ROD AND PIPE PUSHER, PULLER DEVICE

This is a continuation in part of my co-pending Patent Application entitled "PIPE GUIDE MEANS FOR A ROD AND PIPE PUSHER", Ser. No. 482,275 and filed June 24, 1974, now U.S. Pat. No. 3,907,253, issued Sept. 23, 1975.

BACKGROUND OF THE PRESENT INVENTION

In routine procedures, operating and target trenches are dug on opposite sides of a driveway, street, etc., under which a pipe, service line, etc., is to be installed. The bucket and operating linkage of a conventional truck or tractor mounted backhoe machine is conventionally disassembled and replaced by a rod and pipe pusher, puller device which device is then positioned and braced in the operating trench. A first rod length is manually inserted through a pair of drive jaws and engaged thereby to push said first rod length under the street, driveway, etc. The trailing end of the first rod length is provided with a coupling to receive a second rod length whereupon the hydraulic drive means is reactivated to push the second rod length forwardly toward the target trench. A sufficient plurality of rod lengths are similarly attached to preceeding rod lengths until the leading tip end of the first rod length emerges into the target trench.

The leading tip end is threadably provided with a pusher cap which is then removed and replaced with an adaptor for the attachment to the end of a pipe to be permanently installed under the above finished surface; said pipe being so installed by reconditioning the bracing means and drive jaws to reverse the direction of movement to pull the pipe back through the hole formed by the rod until the leading end thereof, coupled to the rod emerges into the operating trench.

The above described device and operation thereof is quite conventional, however, certain difficulties and deficiencies have existed principally because of the fact that the backhoe bucket and operating linkage had to be completely removed for installation of the rod and pipe pusher, puller device. Particularly in long pipe installations of 100, 200 or more feet in length, obstructions are frequently encountered which divert the push rods to an extent that the leading end thereof misses the target trench. It then becomes necessary for a crew of men to dig with shovels until they find said leading end.

This is necessary because the removal of the rod and pipe pusher, puller device from the backhoe, the connection of the backhoe bucket thereto and the subsequent removal of the bucket and reinstallation of the pipe pusher, puller device for the pipe pulling operation is so time consuming that it is impractical to use the backhoe for the digging operation required to find the end of the rod.

The above described conventional operation is complicated by the bulk and weight of the bucket and pusher, puller device. It is generally accomplished by a first man operating the hydraulic controls of the backhoe device in an attempt to axially align the respective holes for the necessary pinned connections and a second man who must accomplish the various connections. The complete removal of the bucket and associated linkage, the installation of the rod and pipe pusher, puller, the removal thereof and the reinstallation of the bucket generally consumes a number of man hours of work.

With the device of the present invention, neither the bucket or associated linkage is removed for the connection to the rod and pipe pusher, puller device. In fact, a single pin must be removed to connect said device to the backhoe machine. Consequently the device may be disconnected and the bucket reactivated in a metter of minutes for use in a digging operation to find said leading rod end. In like manner, the bucket may be deactivated and said device reconnected to perform the operation of pulling the pipe back through the hole formed by the rod in a manner of minutes.

OBJECTS AND ADVANTAGES OF THE PRESENT INVENTION

One of the principal objects of the present invention is to provide a rod and pipe pusher, puller device which can be operably connected to a conventional backhoe machine without removal of the bucket therefrom.

Another principal object of this invention is to provide a rod and pipe pusher, puller device for installing a pipe under a finished surface such as a driveway, street, etc., which can be readily installed relative to a conventional backhoe machine after the removal of a single pivot pin from the drive linkage connection of the bucket to the operating means thereof.

A further object of this invention is to provide the connection between the dip stick of the backhoe machine, with the bucket attached thereto in a generally centered relation and the rod and pipe pusher, puller to better stabalize same to avoid any floating or drifting thereof when in use.

DETAILED DESCRIPTION OF THE DRAWINGS

Figure 1:
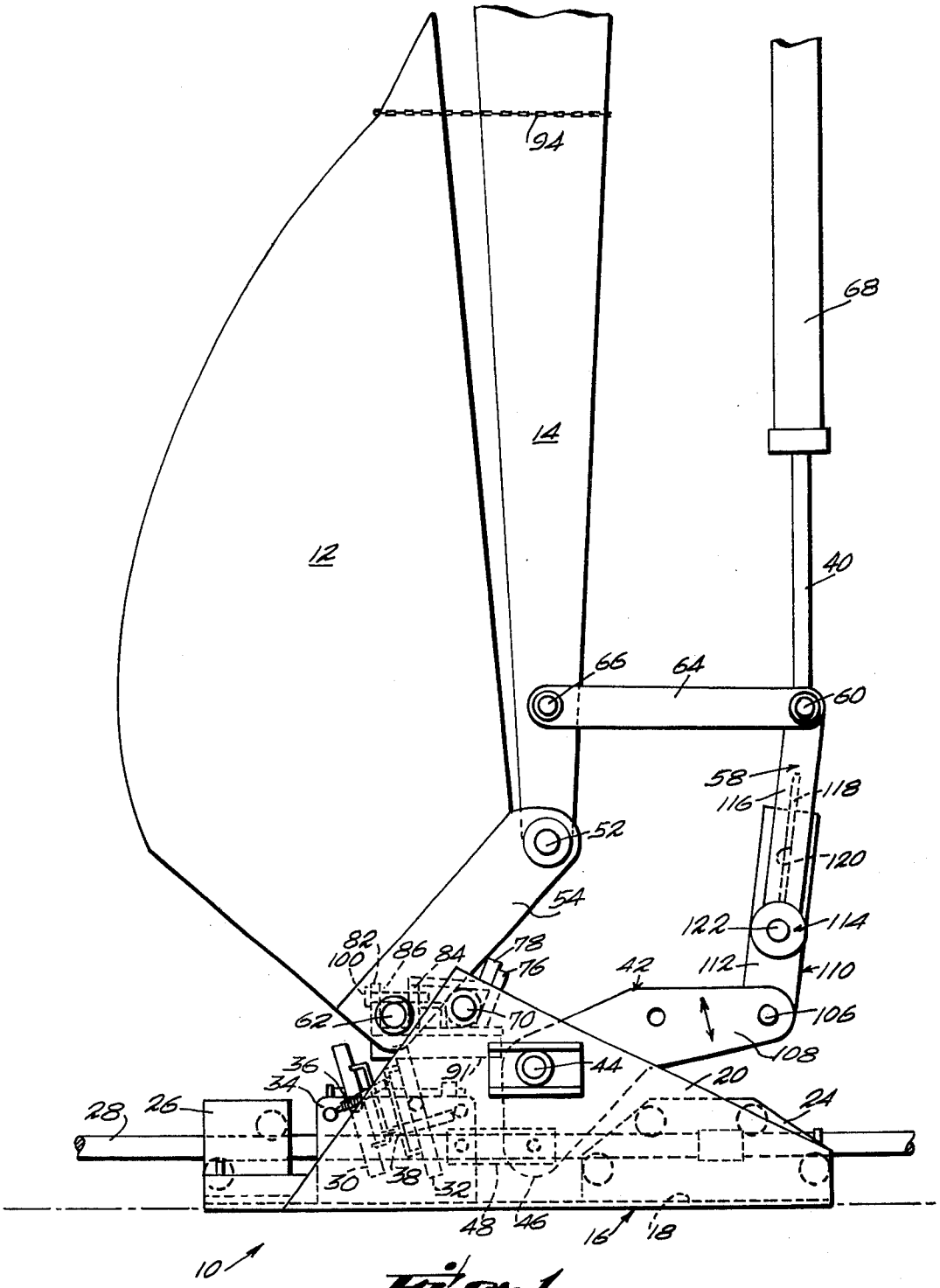
FIG. 1 is a side elevational view of the rod and pipe pusher, puller device of the present invention, installed relative to a dip stick and operating hydraulic ram of a conventional backhoe machine with the bucket thereof in place.

With reference to the drawings in which like reference characters designate like or corresponding parts throughout the various views and with particular reference to FIG. 1, the rod and pipe pusher, puller device of the present invention is designated generally at 10 in a connected relation to the bucket 12, carried by the dip stick 14 of a conventional backhoe machine (not shown).

In operation, the device 10 is positioned in an operating trench on one side of a finished surface under which a pipe is to be installed, and is comprised generally of a main frame 16 including a bottom wall 18 and a pair of upstanding, generally triangular, spaced apart side walls 20 and 22. Front and back roller guide assemblies 24 and 26 are fixed relative to the bottom wall 18 to direct a pipe or a rod 28 therethrough. The pipe or rod 28 is in the form of coupled sections and is drivingly engaged by a pair of drive jaws 30 and 32, pivotally engaged in a slide box 34, slidably engaged along the bottom wall 18.

The drive jaws 30 and 32 are adjustably angled by springs 36 and 38 to drive a pipe or rod 28 either forwardly or backwardly. In practice, a rod is engaged through the guide roller assemblies 24 and 26 and the drive jaws 30 and 32 are angled to drive the rod through the soil under a finished surface such as a driveway, street, etc., by means of the hydraulic piston rod 40 which drives a power arm 42 in the form of a bell crank, pivotally connected at 44 between the side walls 20 and 22. A first lever arm 46 of the bell crank 42 is pivotally linked at 48 to the slide box 34 to impart a forward and backward reciprocating movement thereto to impart a forward or backward movement to the pipe or rod 28 depending upon the setting of the drive jaws 30 and 32.

After the rod is driven under the finished surface, a pipe is coupled thereto, the drive jaws 30 and 32 are reversed to withdraw the pipe through the hole formed by the rod until it emerges into the operating trench. The guide roller assemblies 24 and 26, and the drive jaws 30 and 32 as generally illustrated and described are the subject matter of my two co-pending patent applications Ser. No. 482,275 filed June 24, 1974, and Ser. No. 590,847 filed June 26, 1975.

Figure 5:
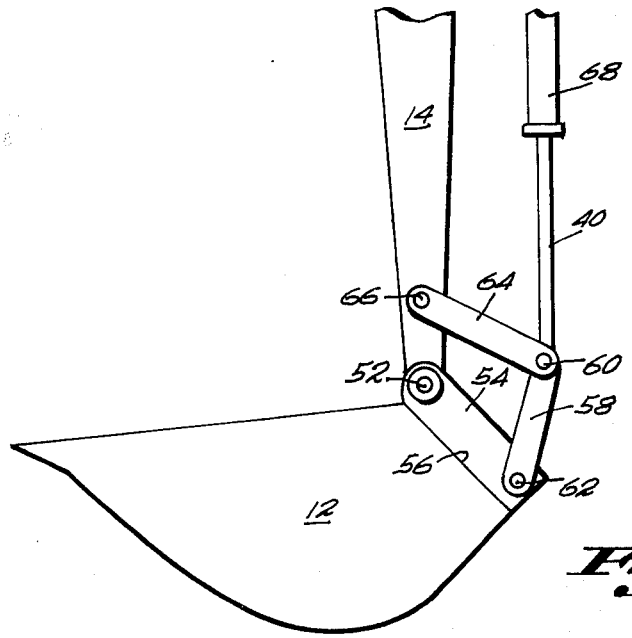
FIG. 5 is a side elevational view showing the rod and pipe pusher, puller device removed with the bucket in normal operating relation.

FIG. 5 illustrates a conventional attachment arrangement of a bucket 12 to a dip stick 14 of a backhoe machine (not shown). The dip stick 14 is pivoted at 52 to the first ends of a pair of links 54 (one shown in FIG. 5), fixed along the back wall 56 of the bucket 12. A link 58 is pivotally connected at 60 and 62 between the end of piston rod 40 and the second end of link 54. An intermediate link 64 is pivotally connected between the end of the piston rod 40 and the dip stick 14 at 60 and 66. Operation of the hydraulic ram 68 actuates the bucket 12 in a conventional manner by means of the piston rod 40.

Figure 2:
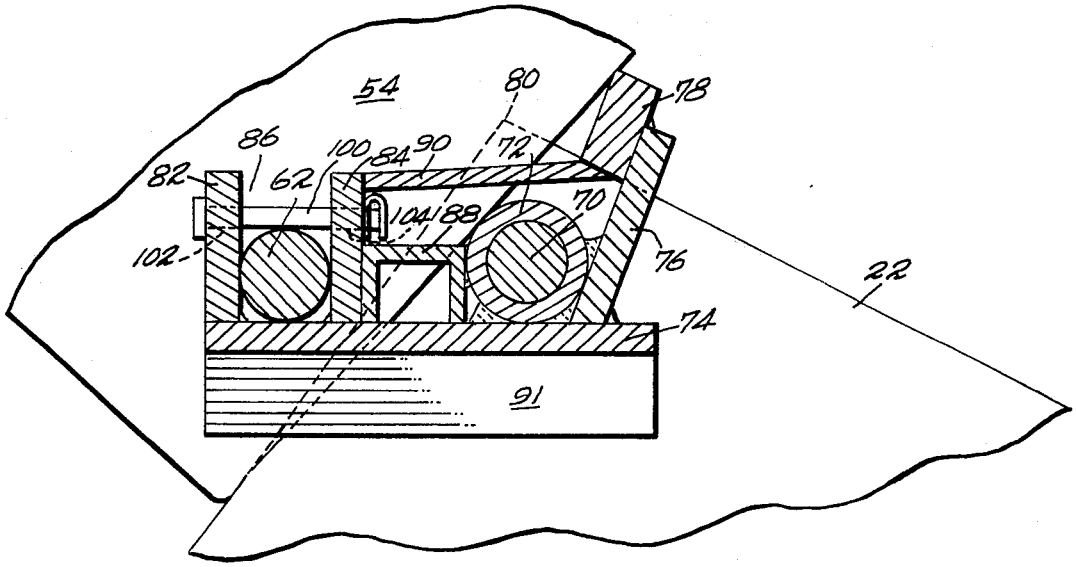
FIG. 2 is an enlarged longitudinal sectional view through the upper central portion of the device, illustrating the connection to the backhoe bucket.
Figure 3:
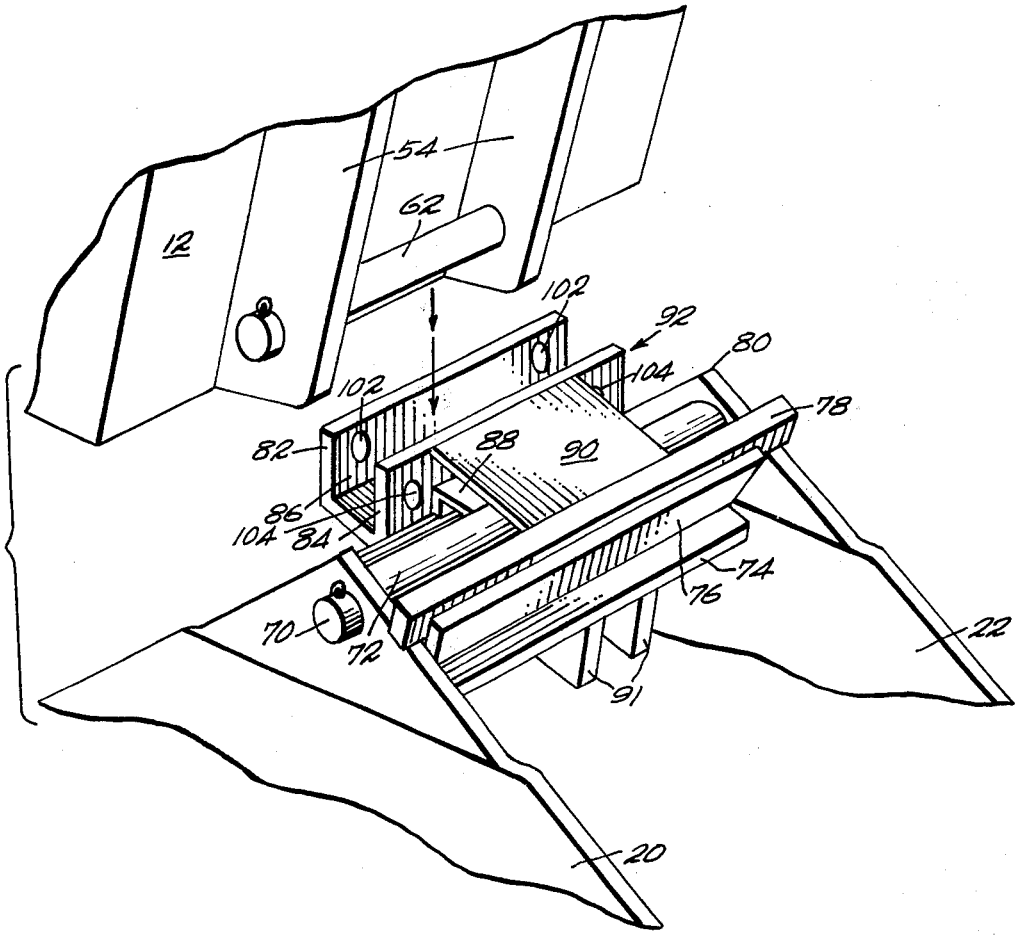
FIG. 3 is a perspective view of the connection means of FIG. 2.

With particular reference to FIGS. 2 and 3, the central apex portion of the triangular side walls 20 and 22 are provided with aligned through holes for the transverse reception of a pin 70 for engagement through a sleeve 72 intermediate said side walls 20 and 22. The sleeve 72 is fixed as by welding to a base plate 74 having an upstanding member 76 welded thereto which is similarly welded to an upper transverse bar 78 positioned to straddle and normally rest upon the top edges of side walls 20 and 22 on a first side of the apex 80.

The base plate 74 extends longitudinally across to the second side of said apex 80 and is provided with a pair of spaced apart upstanding transverse flanges 82 and 84 defining a channel 86. Additional strengthening means in the form of inverted channel 88, plate 90 and ribs 91 may be welded in place. The bracket assembly 92, supported by pin 70 as above described, provides a support for the bucket 12 and connection to the dip stick 50 by means of limbs 54.

In operation, the bucket 12 is operated to move it to the generally vertical position illustrated in FIG. 1 by means of the hydraulic piston 40. The bucket is then fixed as by chain 94 to the dip stick 50 and the pivot pin 62 is removed to disconnect the links 54 and 58. The pin 62 is then reinserted through the bucket links 54 as illustrated in FIGS. 2 and 3 and dropped into the channel 86 where it is captivated by any conventional type of keeper means such as pins 100 (one shown in FIG. 2) engaged through axially aligned pairs of holes 102 and 104. In the normal, at rest position of the bucket, the bucket links 54 bear against the transverse bar 78 to better stabilize the device 10 while in operation.

Figure 4:
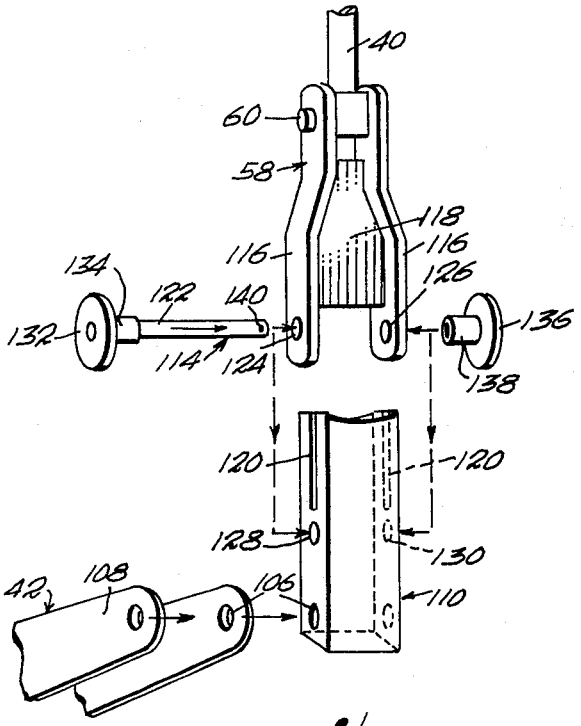
FIG. 4 is an exploded perspective view of a connector extension between the operating end of the hydraulic ram piston and a power arm of the device.

The link 58 is then connected at 106 to a second operating lever arm 108 of bell crank 42. As illustrated in FIGS. 1 and 4, an extension 110 may be necessary to provide for a proper amount of movement of the bell crank 42. It may be in the form of an elongated rectangular tubular member 112 pivotally connected at 106 to the bell crank arm 108 and a pinned connection 114 to link 58. The link 58 is comprised of a pair of arms 116-116 spanned by intermediate transverse web 118, and the extension 110 is provided with slot means 120 to slidably receive the web 118 to key the two members in a rigid connection.

The pinned connection 114 may be comprised of a rod 122 extending through pairs of axially aligned holes 124 and 126 in the arms 116-116 and holes 128 and 130 in the extension 110. A knob 132 with an inwardly extending sleeve 134 is rigidly fixed to one end of the rod 122. A knob and sleeve 136 and 138 is slidably received on the extended end of the rod 122 after it is inserted through the holes 124, 126, 128 and 130 and pinned in place through a suitable hole 140.

As illustrated in FIG. 1, the bell crank power arm 42 may include a second hole 142 to receive the pivotal connection 106 when the going is easy, that is when the pushing operation is easy. This provides for a faster pushing operation and the operator of the device has a better feel of any obstruction.

In operation, the pusher, puller device 10 is transported and positioned by the backhoe device by means of the captivated engagement of pivot pin 62 in channel 86. After the device 10 is positioned in the operating trench, the downward forces of the dip stick 14 and the weight of the bucket 12 combined with the upper central connection 70 thereof stabilizes the device 10 for the rod pushing and pipe pulling operations as previously described.

I claim:

1. A rod and pipe pusher, puller device for location in an operating trench adjacent to a first side of a finished surface for connection to, and operation by a conventional backhoe device, including a dipstick, to push a rod under the finished surface into a target trench located on the second side thereof, and to withdraw a pipe attached to the end of the rod in the target trench back under the finished surface to the operating trench, said device comprising, A. a generally channel shaped main body portion including
   1. a bottom wall and
   2. a pair of spaced apart upstanding side walls;

B. a slide box, slidably journalled along said bottom wall;

C. a power arm in the form of a bell crank journalled between said side walls and including,
   1. a first lever arm pivotally connected at its outer end to an extended end of a hydraulic ram piston forming a part of the backhoe device,
   2. a second lever arm pivotally linked to said slide box to said slide box to impart reciprocating, back-and-forth movement thereto upon conventional operation of said ram piston;

D. drive jaw means pivotally connected within said slide box to drivingly engage a rod or pipe passing therethrough, said drive jaws including means to reverse the direction of drive thereof;

E. means to connect the conventional backhoe bucket, while it is attached to the backhoe dipstick, to the rod and pipe pusher, puller device in a spanning relation to an upper, generally central portion of said side walls.

2. The rod and pipe pusher, puller device as defined in claim 1 wherein said means to connect comprises a transverse bracket pivotally pinned between said upper, generally central side wall portions.

3. The rod and pipe pusher, puller device as defined in claim 2 wherein said transverse bracket includes a transverse channel portion to receive a transverse pivot pin normally engaged through link means fixed relative to the rear end of the bucket.

4. The rod and pipe pusher, puller device as defined in claim 2 wherein said transverse bracket includes a transverse bar fixed thereto, sized and positioned to overlie and bear against the top edge portion of both of said side walls to stabalize said bracket.

5. The rod and pipe pusher, puller device as defined in claim 3 including keeper means engaged through said channel portion in a manner so as to captivate said transverse pivot pin.

6. The rod and pipe pusher, puller device as defined in claim 1 including extension means connected between said piston extended end and first lever arm.

7. The rod and pipe pusher, puller device as defined in claim 6 wherein said extension means comprising an elongated tubular member pivotally connected at a first end to said first lever arm, linkage means forming a portion of the conventional backhoe structure, pivotally connected at an upper end to said piston extended end and pinned at a lower end to a central portion of said tubular member, and means to key said linkage means to said tubular member.

8. The rod and pipe pusher, puller device as defined in claim 7 wherein said means to key comprises a central web spanning the distance between two spaced apart link arms, comprising said linkage means, and slot means in the upper portion of said tubular member to slidably engage said web.

* * * * *